US005122409A

United States Patent [19]

Akutsu et al.

[11] Patent Number: 5,122,409

[45] Date of Patent: Jun. 16, 1992

[54] INK TRANSFER MEDIUM OF THE ELECTRICALLY FUSIBLE TYPE

[75] Inventors: Eiichi Akutsu; Hiroo Soga, Ebina; Yuzuru Fukuda, Minamiashigara; Shigehito Ando, Ebina, all of Japan

[73] Assignee: Fuji-Xerox Co., Ltd., Ebina, Japan

[21] Appl. No.: 430,283

[22] Filed: Nov. 2, 1989

[30] Foreign Application Priority Data

Nov. 29, 1988 [JP] Japan ..... 63-299494

[51] Int. Cl.[5] ..... B41M 5/20

[52] U.S. Cl. ..... 428/212; 428/195; 428/216; 428/315.5; 428/315.7; 428/315.9; 428/317.9; 428/333; 428/336; 428/484; 428/488.1; 428/913; 428/914

[58] Field of Search ..... 428/195, 484, 488.1, 428/488.4, 913, 212, 214–216, 315.5, 315.7, 315.9, 317.9, 333, 336, 914

[56] References Cited

U.S. PATENT DOCUMENTS 4,897,669 1/1990 Akutsu et al. ..... 428/484

FOREIGN PATENT DOCUMENTS 53-84735 7/1978 Japan ..... 428/195
56-93585 7/1981 Japan ..... 428/195

*Primary Examiner*—Pamela R. Schwartz
*Attorney, Agent, or Firm*—Finnegan, Henderson, Farabow, Garrett & Gunner

[57] ABSTRACT

An ink transfer medium, and a method for manufacturing the medium are provided. The ink transfer medium is of the electrically fusible type, and has an anisotropically electrically conductive layer characterized by greater electrical conductivity in the direction normal to the surface of the layer than in a direction parallel to the surface of the layer. Other layers, sequentially provided next to each other, include a resistive layer for converting an electrical signal into heat, a conductive layer, an ink separation layer, and a fusible ink layer. Examples are given illustrating the use of the ink transfer medium.

6 Claims, 3 Drawing Sheets

INK TRANSFER MEDIUM OF THE ELECTRICALLY FUSIBLE TYPE

BACKGROUND OF THE INVENTION

1. Field of the Invention

The present invention relates to an ink transfer medium of the electrically fusible type, in which an electric signal is converted into thermal energy to transfer an imaging ink to an ink reception material.

2. Prior Art

One type of prior art ink transfer medium is disclosed in the Japanese Patent Application (OPI) No. 84735/78 (the term "OPI" as used herein means an "unexamined published application"). It comprises an ink film coated with a low-melting-point ink on one side, and a thermal printing head pushed onto the other side of the ink film to conduct heat to melt the ink to transfer it for imaging. Since the heat is conducted through a relatively long distance in the medium, the speed of printing of the ink is low, taking 1 msec or more per dot to perform the printing. Further, since transmissible energy in the medium is low, the choice of materials for the ink is greatly constrained, thus lowering the controllability of the transference of the ink and making dot modulation impossible; or the main constituent of the ink is limited to be a wax or the like.

A second prior art ink transfer medium is disclosed in the Journal of the Institute of Image Electronics Engineers of Japan, No. 1, Vol. 11, 1982 and the Drafts 17 for the 12-th National Convention of the Institute. In this second prior art medium, electric signals corresponding to an image are applied from stylus electrodes into the ink layer of the medium through the ink carrier thereof to generate heat to melt the ink layer to transfer it for imaging. As shown in FIG. 5, the ink transfer medium comprises an anisotropically electrically conductive layer 51, an electrically conductive heating layer 52 and the electrically conductive ink layer 53. The anisotropically electrically conductive layer 51 is the carrier of the layers 52 and 53, and is composed of a resin and a metal powder dispersed therein. The layer 51 is formed as a ribbon. The layer 51 may be substituted by an electrically conductive film of high electric resistance.

A problem with this second kind of prior art recording medium is that the electrical conductivity of the ink transfer medium makes it difficult to control the tones of colors, thereby making it difficult to make a color image through the use of the medium. Further, the ink carrier of the medium has large electrical energy dissipation and is relatively low in mechanical strength. The accuracy of dots printed through the use of the medium is low. Since the electrical anisotropy of the medium is insufficient, current spreading occurs in the carrier ribbon of the medium to cause a large loss of energy.

A third type of prior art ink transfer medium is disclosed in the Japanese Patent Application (OPI) No. 93585/81. It is composed of carrier of moderate electric resistance, a heating layer, and return passage electrodes. Applied electrical current passages are produced in the medium through the carrier thereof by stylus electrodes to generate heat to melt an ink layer to transfer it for imaging. The carrier of the ink transfer medium has no electrical conductivity anisotropy, however, causing the area of each dot printed through the use of the medium to be enlarged. Since a spreading current which does not contribute to the effective localized generation of the heat in the medium is excessive, the energy efficiency of the medium is low. Since the carrier of the medium is electrically resistive, the contact resistance between the carrier and the stylus electrode is high.

A forth type of prior art ink transfer medium is shown in FIG. 6. Return passage electrodes 62 are provided on the same side as printing electrodes 61, as shown in FIG. 6, and electric signals corresponding to an image are applied from stylus electrodes so that electrical current passages 67 extending to the return passage electrodes are produced in the heating resistor layer 63 of the medium comprising the heating resistor layer, an electrically conductive layer 64 and an ink layer 65, to generate heat in the heating resistor layer to melt the ink layer to transfer it for imaging.

In this forth type of prior art device, since an applied electric current flows through the heating resistor layer of the ink transfer medium twice due to the electrical current passage extending to the return passage electrode, a double energy loss is caused. Since sliding contact is performed twice by the stylus electrode and the return passage electrode for the medium, a double heat loss is caused due to the contact resistance between the electrodes. Since some electric resistance needs to be provided in the electrically conductive passage of the ink transfer medium in order to cause an electrical current to flow, with priority, to the return passage electrode, a large heating loss is caused in the electrically conductive passage.

SUMMARY OF THE INVENTION

An object of the ink transfer medium of the present invention is to avoid the above-mentioned problems of the prior art electric ink transfer media of the electrically fusible type. Accordingly, it is an object of the present invention to provide an ink transfer medium of the electrically fusible type which allows a print-recording process for a high-definition image to be rapidly performed. Repeated printing can be performed with lower energy and a high-quality color image of many gradations can be created with high reproducibility of dots at a lower operating cost.

According to one aspect of the present invention, an ink transfer medium of the electrically fusible type comprises a first electrically conductive layer having a bottom surface, and anisotropic properties comprising greater electrical conductivity in the direction normal to the bottom surface than in the directions parallel to the bottom surface; a heating resistor layer sequentially provided next to the bottom surface of the first electrically conductive layer; a second electrically conductive layer sequentially provided next to the heating resistor layer; an ink separation layer sequentially provided next to the second electrically conductive layer; and a fusible ink layer sequentially provided next to the ink separation layer.

According to another aspect of the present invention, a method for manufacturing an ink transfer medium of the electrically fusible type comprises the steps of forming a porous alumina body from a thin-walled hollow aluminum cylinder; filling the porous body with a conductor; depositing a heat resistor layer on the outside surface of the body; subsequently, depositing an electrically conductive layer onto the heat resistor layer; subsequently, depositing an ink separation layer onto the electrically conductive layer.

Figure 1:
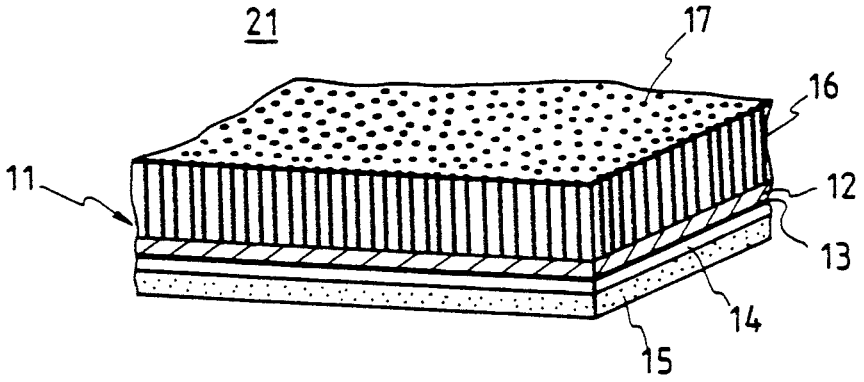
FIG. 1 is a perspective view of an ink transfer medium which is an embodiment of the present invention.

Shown in the drawings of the invention are an anisotropically electrically conductive layer 11, including a porous alumina base 16 and an electrically conductive substance 17, filling the pores, a heating resistor layer 12, an electrically conductive layer 13, an ink separation layer 14, a fusible ink layer 15, all comprising an ink transfer medium 21. The apparatus method of the invention, in FIG. 2, employs transfer medium 21, a print-recording head 22, ink reception paper 23, a pressure contact back roller 24, or, in FIGS. 3 and 4, a pattern electrode 36, an elastic member 37, a pressure contact rigid body 38, an electrically insulating plate 41, a cylindrical thin aluminum sheet 42, an electrolytic solution 43, an electrode 44, and a DC power supply 45.

DETAILED DESCRIPTION OF THE PREFERRED EMBODIMENTS

Figure 2:
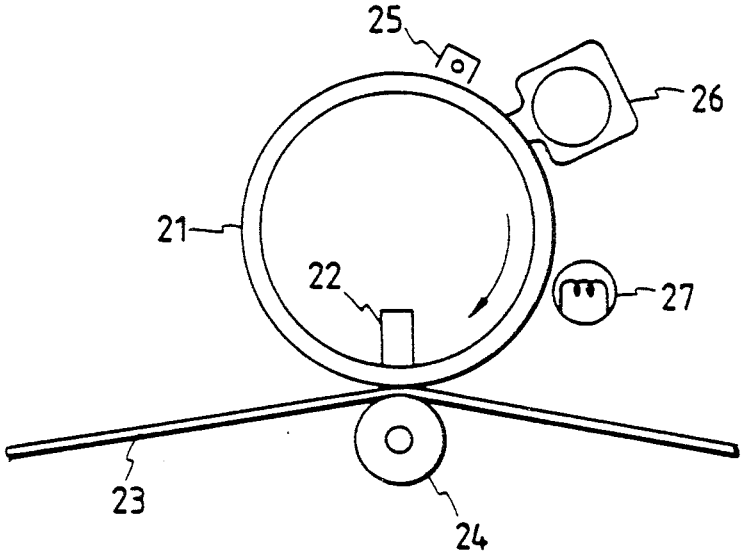
FIG. 2 is a view for describing a print-recording process employing an embodiment of the ink transfer medium of the present invention.

FIG. 2 shows an apparatus for practicing a process of print-recording employing an embodiment of the ink transfer medium 21 of the present invention 21, as shown in FIG. 1. The medium 21 is rotated in a direction shown by an arrow in FIG. 2, by a drive means not shown therein. The medium 21 comes into contact with ink reception paper 23 on a pressure contact back roller 24. A print-recording head 22 is put into pressure contact with the anisotropically electrically conductive layer of the medium to apply electric signals to the layer to melt the fusible ink layer of the medium to transfer the ink onto the ink reception paper 23, thus performing the print-recording. The ink transfer medium is thereafter electrified by a charger 25 and supplied with the ink. The surface of the ink layer of the medium is then conditioned by a setting heat roller 27.

Figure 3:
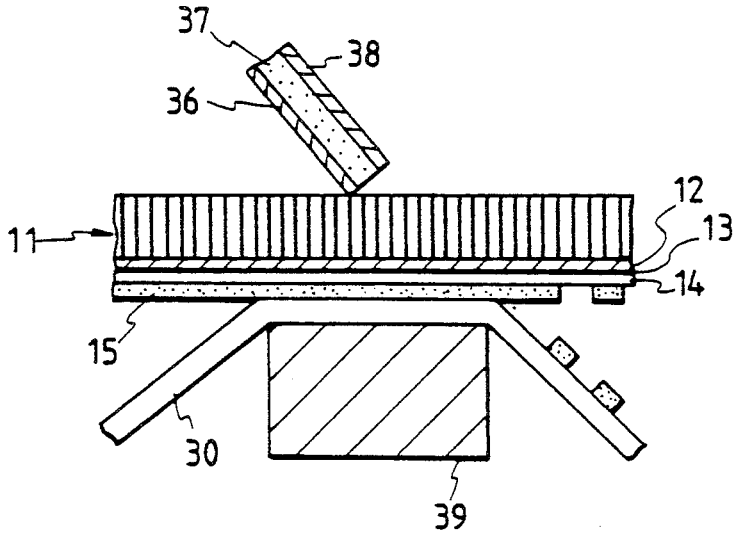
FIG. 3 is another view for describing a print-recording process employing an embodiment of the ink transfer medium of the present invention.

FIG. 3 shows another apparatus for practicing a print recording process employing an embodiment of the ink transfer medium 21 of the present invention. In FIG. 3, a print recording head comprises a pattern electrode 36, an elastic member 37 and a pressure contact rigid body 38. Pattern electrode 36 is put into pressure contact with the surface of the anisotropically electrically conductive layer 11 of the ink transfer medium 21 of FIG. 1 comprising the layer 11, a heating resistor layer 12, an electrically conductive layer 13, an ink separation layer 14 and a fusible ink layer 15. The fusible ink layer 15 comes into contact with ink reception paper 30 on a pressure contact back member 39. After an image signal current from the pattern electrode 36 flows through the anisotropically electrically conductive layer 11 and causes the heating resistor layer 12 to heat, the current flows through the electrically conductive layer 13 and reaches a return passage electrode circuit not shown in FIG. 3. Since the direction of the flow of the image signal current through an electrically conductive substance 17 filled in the through-pores of the alumina base 16 of the anisotropically electrically conductive layer 11 is perpendicular to the surface of the layer, the current reaches the heating resistor layer 12 without leaking or spreading in a direction parallel with the surface of the layer 11. For that reason, the fusible ink layer 15 is melted correspondingly to the image signal current and then transferred to the ink reception paper 30. As a result, an image is printed without the enlargement of each printed dot. Further, the anisotropically electrically conductive layer 11 acts so that an electric energy loss due to the electric resistance of the layer, and the flowing of the current in the direction normal to the surface of the layer is low, and a heating loss due to the contact resistance between the surface of the ink transfer medium and the print-recording head and the heating damage to the surface of the medium are reduced.

An embodiment of the present invention will now be described in detail with reference to the drawings. FIG. 1 is a perspective view of an embodiment of the preferred ink transfer medium of the present which is of the electrically fusible type. In this embodiment, the medium comprises an anisotropically electrically conductive layer 11, a heating resistor layer 12, an electrically conductive layer 13, an ink separation layer 14 and a fusible ink layer 15 which are sequentially provided.

The anisotropically electrically conductive layer 11 includes a cylindrical porous alumina base 16 and an electrically conductive substance 17 filled in through-pores of the base. The alumina base 16 is manufactured by anodic oxidation, with the through-pores each having a diameter of 50μ or less. It is preferable that the electric conductivity of the layer 11 in the direction normal to the surface of the layer is at least ten times higher than that each of the directions parallel to the surface of the layer. For example, the electric resistance of the layer 11 in the normal direction is set at 10 $\Omega/mm^2$ or less, preferably at $10^{-1}$ $\Omega/mm^2$ or less, and that of the layer in each of the parallel L directions is set at $10^5$ $\Omega/mm^2$ or more, preferably at $10^{11}$ $\Omega/mm^2$ or more. It is preferable that the diameter of each of the through-pores of the alumina base 16 be 50μ or less. If the diameter were larger than 50μ, the heating damage to the surface of the ink transfer medium would be enlarged and the area of each printed dot would be increased to lower the reliability of printing. It is preferable that the thickness of the layer 11 is 20μ to 3 mm.

Figure 4:
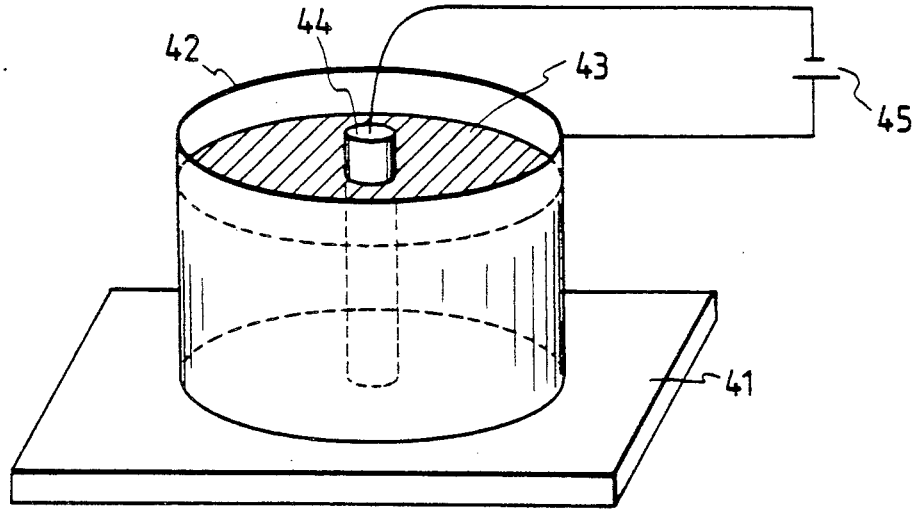
FIG. 4 is a view for describing a procedure of manufacturing the anisotropically electrically conductive layer of the ink transfer medium.
Figure 5:
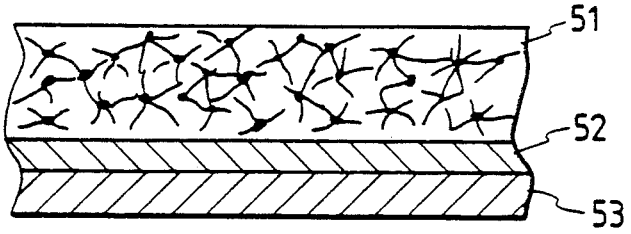
FIG. 5 PRIOR ART
FIG. 5 is a sectional view of a prior art ink transfer medium.
Figure 6:
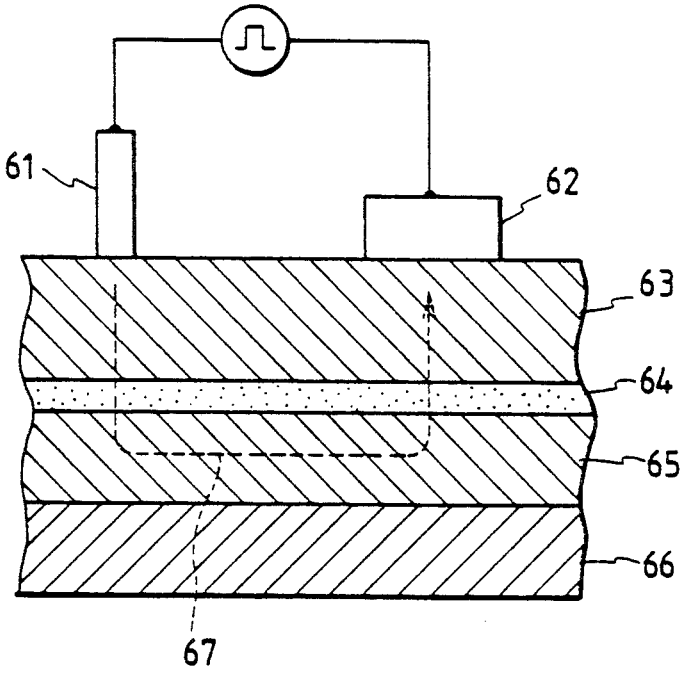
FIG. 6 PRIOR ART
FIG. 6 is a view for describing another prior art ink transfer medium.

By way of example, an outline of a method, currently the best mode, for manufacturing the anisotropically electrically conductive layer 11 will now be described. As shown in FIG. 4., a thin cylindrical aluminum sheet 42 is set up on an electrically insulating plate 41 and filled with an electrolytic solution 43. The electrolytic solution 43 is an aqueous solution of an electrolyte such as phosphoric acid, oxalic acid, sulfuric acid or chromic acid. If the electrolyte is solid, the quantity thereof is 0.01% to 90% by weight of the solution. If the electrolyte is liquid, the quantity thereof is 0.01% to 80% by volume of the solution. An electrode 44 having a circular or polygonal cross section and made of platinum, stainless steel, aluminum or the like is disposed as a cathode at the cylindrical axis of the aluminum sheet 42. The plus terminal of a DC power supply 45 is connected to the aluminum sheet 42 as an anode, while the minus terminal of the supply is connected to the electrode 44. An electrical current is thus caused to flow between the anode and the cathode so that a porous alumina film is produced on the inside surface of the cylindrical aluminum sheet 42. It is preferable that the electrolytic solution is heated at 20° C. to 95° C. throughout the period of the application of the electrical current. In the case that the density of the electrical current is 1 $A/dm^2$ to 100 $A/dm^2$ and the current is a pulse or a direct current, the speed of the growth of the porous alumina film is about 300 Å/min. to about 3 μ/min. The pores, similar in form to each other, and each having a diameter of 100 Å to 2,000 Å are made in the alumina film so that the pores grow in a direction normal to the inside surface of the aluminum sheet 42 and have a density of $10^8$ to $10^{11}$ in number per square centimeter. The depth of each of the pores is nearly equal to the thickness of the porous alumina film. The porous alumina base 16 is thus manufactured. The pores of the base 16 are then filled with the electrically conductive substance 17 by nonelectrolytic plating, electrolytic plating, molten metal spraying or the like so that the anisotropically electrically conductive layer 11 is constituted. After that, the cylindrical aluminum layer remaining outside the layer 11 is removed by lapping or etching.

In FIG. 2 or FIG. 3, the heating resistor layer 12 generates Joule heat due to an electrical current flowing from the anisotropically electrically conductive layer 11, so that the ink layer 15 becomes molten or is sublimed and then transferred to an ink reception material.

Therefore, in the further process of making medium 21, starting from the product of FIG. 4, a mixture of a high-electric-resistance substance such as $ZrO_2$, $Al_2O_3$, $SiO_2$ and BN and an electrically conductive substance such as Ti, Al, Ta, Cu, Au and Zr or a heat-withstanding electrically conductive resin such as a resin containing minute electrically conductive particles dispersed therein is provided in the form of a thin film on the anisotropically electrically conductive layer 11 so as to constitute the heating resistor layer 12. It is preferable that the volume resistivity of the layer 12 is set as $10^{-2}$ Ω·cm to $10^2$Ω·cm, and the thickness of the layer is set at 500 Å to 10μ. At these set values, the layer 12 is sufficiently stable and adhesive on the layer 11.

The electrically conductive layer 13 serves as an electrode so that the electrical current flowing into the heating resistor layer 12 is diffused and returned. The electrically conductive layer 13 is made of a substance of $10^{-2}$ Ω·cm or less in volume resistivity, using evaporation coating, sputtering or other procedure of thin film manufacturing. It is preferable that the thickness of the layer 13 is set at 500 Å to 3μ. It is more preferable that the thickness is set at 1,000 Å to 2,000 Å for better heat release and higher electric conductivity.

The ink separation layer 14 is preconditioned to have a critical surface tension such that the ink layer 15 is well transferred to the ink reception material even if the energy for printing the ink onto it is low. The layer 14 is made of a thin film of low surface energy. Basically, the critical surface tension of the layer 14 is lower than that of the ink reception material. It is preferable that the critical surface tension of the layer 14 is 39 dyne/cm or less if the ink reception material is ordinary paper. It is preferable that the critical surface tension of the layer 14 is lower than the surface tension of the ink 15, producing an optimal effect for the transference of the ink to the ink reception material. It is preferable from a viewpoint of energy transmission efficiency that the layer 14 is made of a fluorine resin, a silicone resin or the like, for example, to have its thickness minimized in a range from 500 Å to 3μ.

The fusible ink layer 15 is composed of a thermoplastic resin of 130° C. or less in melting point and a conventional coloring substance such as a dye and a pigment. It is preferable that the thickness of the layer 15 is set at 1μ to 25μ. If the thickness were smaller than 1μ, a problem might occur with the reproducibility of dots. If the thickness were larger than 25μ, a larger quantity of printing energy might be needed.

The following actual examples are presented to illustrate various features of the invention. The examples are presented to illustrate, and are not intended as limitations.

ACTUAL EXAMPLE 1

An aqueous solution of sodium hydroxide and pH 10 was put in a hollow aluminum cylinder shaped as an endless belt and having a thickness of 100μ and a diameter of 120 mm. The cylinder containing the solution was then placed in an ultrasonic washing vessel. Ultrasonic waves were applied to the cylinder and the solution for 10 seconds so that the inside surface of the cylinder was subjected to washing and preparatory treatment. After that, the aqueous solution was drained out of the cylinder, an aqueous solution of 4% by volume of phosphoric acid was put as an electrolytic solution in the cylinder, and a platinum rod of 10 mm in diameter was disposed at the center of the cylinder and connected as a cathode to the minus terminal of a DC power supply. The hollow aluminum cylinder was connected as an anode to the plus terminal of the DC power supply so than an electrical current of 60 $A/dm^2$ in density flows between the anode and the cathode in the solution of 20° C. in temperature for 150 minutes to change the inside portion of the cylinder into alumina. After that, the aqueous solution was drained out of the cylinder, an electrolytic solution containing a nickel salt was put in the cylinder, and an alternating current of 30 $A/dm^2$ in density was caused to flow between the platinum rod and the cylinder for 100 minutes to perform AC electrolysis to fill nickel in the pores of the alumina of the cylinder by electrodeposition. The cylinder was thereafter put in a solution consisting of phosphoric acid, nitric acid and water at a weight ratio of 4:2:3. Ultrasonic waves were then applied to the cylinder in the solution for 180 seconds so that the aluminum portion of the cylinder was removed. As a result, a cylindrical endless belt consisting of the alumina and thin electrically conductive wires made of the nickel and extending in direction of the thickness of the belt was obtained. A target made of a mixture of BN, Ta and $SiO_2$ was then subjected to high-frequency sputtering toward the outside surface of the endless belt at a temperature of 580° C. under an atmosphere of argon gas of $10^{-3}$ torr in pressure so that a heating resistor layer 12 of 0.5μ in thickness was created on the outside surface of the belt. An electrically conductive layer 13 of 1,500 Å in thickness was then made of aluminum on the heating resistor layer by vacuum evaporation coating at the room temperature. After a solution of dimethylsiloxane was applied to the electrically conductive layer on the heating resistor layer and dried, the endless belt was subjected to a thermal hardening treatment at a temperature of 200° C. for 30 minutes so that an ink separation layer 14 of 0.2μ in thickness and 33 dyne/cm in critical surface tension was created on the electrically conductive layer 13. A fusible ink layer 15 of 4μ in thickness was then made on the ink separation layer 14 by dispersing 7% by weight of a phthalocyanine pigment in a polyester of 99° C. in melting point. An ink transfer medium 21 having the nickel-filled alumina as an anisotropically electrically conductive layer and shaped as an endless belt was thus manufactured.

Print-recording was then performed through the use of the ink transfer medium 21. A stylus line head of 800 SPI was put into contact with the anisotropically electrically conductive layer 11 of the medium under pressure of 320 g/cm, paper of good quality was put into contact with the fusible ink layer of the medium by an elastic pressure contact roller 24 (see FIG. 2), and a signal current of 12 mA in magnitude and 350 μsec in pulse width was applied to the stylus line head. As a result, a circular dot of 28μ in diameter was made on the paper. Other print-recording was then performed under the same conditions except that a signal current pulse of 19 mA in magnitude and 350 μsec in pulse width was applied to the stylus line head. As a result, a circular dot of 42μ in diameter was made on the paper.

COMPARATIVE EXAMPLE 1

Nickel wires each having a diameter of 20μ were disposed, at intervals of 60μ each, in a silicone elastomer so that the wires extended in the direction of the thickness of the elastomer. An anisotropically electrically conductive layer was thus composed of the silicone elastomer and the nickel wires. A heating resistor layer, an electrically conductive layer, an ink separation layer and a fusible ink layer were sequentially created on the anisotropically electrically conductive layer in the same way as the actual example 1 so that an ink transfer medium was manufactured. Print-recording was performed through the use of the medium under the same conditions as the actual example 1 except that an electrical current of 17 mA in magnitude and 300 μsec in pulse width was applied to the stylus line head. As a result, a circular dot of 50μ in diameter was made, and the surface of the medium underwent heating damage due to the application of the electrical current.

ACTUAL EXAMPLE 2

The inside surface of an hollow aluminum cylinder, prepared as in actual example 1, and shaped as an endless belt was subjected to the same washing and preparatory treatment as in actual example 1. Diluted sulfuric acid of 7% in volume was put as an electrolytic solution in the aluminum cylinder. A rod made of stainless steel such as the SUS 304 and having a diameter of 20 mm was placed at the center of the aluminum cylinder and connected as a cathode to the minus terminal of a DC pulse power supply. The hollow aluminum cylinder was connected as an anode to the plus terminal of the power supply. Pulses of 30% in duty factor, 100 msec in pulse width and 40 A/dm$^2$ in current density were applied between the anode and the cathode in the electrolytic solution of 30° C. in temperature for 200 minutes so that the inside portion of the cylinder was changed into alumina. After that, the electrolytic solution was drained out of the cylinder, another electrolytic solution containing a cobalt salt was put in the cylinder, and an alternating current of 30 A/dm$^2$ in density was then caused to flow between the stainless steel rod and the cylinder to perform AC electrolysis to fill the pores of the alumina portion of the cylinder with cobalt by electrodeposition. The cylinder was thereafter put in an etching solution consisting of phosphoric acid, nitric acid and water at a weight ration of 4:3:2. Ultrasonic wavers were then applied to the cylinder in the etching solution for 200 seconds so that the remaining aluminum was removed from the cylinder. A cylindrical endless belt was thus made of the alumina having through-pores filled with thin wires made of the cobalt and extending in the direction of the thickness of the belt. After that, a target made of a mixture of BN, Ta and $SiO_2$ was subjected to high-frequency sputtering toward the outside surface of the endless belt at a temperature of 400° C. under an atmosphere of argon gas of $10^{-3}$ torr in pressure so that a heating resistor layer of 1.2μ in thickness was created on the outside surface of the belt. An electrically conductive layer of 1,000 Å in thickness was made of aluminum on the heating resistor layer by vacuum evaporation coating at the room temperature. After a solution of dimethylsiloxane was applied to the electrically conductive layer and dried, the belt was subjected to a thermal hardening treatment at a temperature of 200° C. for 30 minutes so that an ink separation layer 14 of 0.3μ in thickness and 31 dyne/cm in critical surface tension was created on the electrically conductive layer. A fusible ink layer 15 of 5μ in thickness was made on the ink separation layer by dispersing 5% by weight of a carbon black pigment in a polyester of 87° C. in melting point, so that an ink transfer medium 21 shaped as an endless belt was manufactured. After that, print-recording was performed through the use of the ink transfer medium as a stylus line head of 600 SPI was put into contact with the inside surface of the medium under pressure of 480 g/cm, paper of good quality was put into contact with the fusible ink layer of the medium by an elastic pressure contact roller 24 and a signal current of 8 mA in magnitude and 100 μsec in pulse width was applied to the head. As a result, a good circular dot of 52μ in diameter was made on the paper.

CONCLUSION

The ink transfer medium of the present invention provides repeated, rapid, high-definition print-recording. Further, a high-quality durable color image of many gradations can be print-recorded with high reproducibility for printed dots. The energy efficiency of a print-recording process employing the medium is superior to the prior art. The ink transfer medium is of the electrically fusible type has an anisotropically electrically conductive layer as described above, having a reduced electrical energy loss due to the electric resistance of the layer at the time of application of an electrical current in the direction of the thickness of the layer in print-recording. Further, a heating loss due to the contact resistance between the surface of the medium and a print-recording head and the heating damage to the surface of the medium are reduced. As a result, the reliability of the print-recording is heightened. Since heating in the electrical current passage of the medium is locally limited, an unnecessary heating loss is avoided. The operating cost for a print-recording process employing the medium is lower, and the area of each dot print-recorded through the use of the medium can be changed by altering a printing input, namely, dot modulation can be easily performed with the medium. Desirable effects are thus produced.

Additional advantages and modifications will readily occur to those skilled in the art. The invention in its broader aspects is therefore not limited to the specific details, representative apparatus, and illustrative examples shown and described. Accordingly, departures may be made from such details without departing from the spirit or the scope of applicant's general inventive concept.

What is claimed is:

1. An ink transfer medium of the electrically fusible type comprising:

a first electrically conductive layer including a cylindrical alumina base manufactured by anodic oxidation and having through-pores each having a diameter of 50μ or less, and an electrically conductive substance filled in said pores, a bottom surface, and anisotropic properties comprising greater electrical conductivity in the direction normal to the bottom surface than in the directions parallel to the bottom surface;

a heating resistor layer sequentially provided next to the bottom surface of the first electrically conductive layer;

a second electrically conductive layer sequentially provided next to the heating resistor layer;

an ink separation layer sequentially provided next to the second electrically conductive layer; and a fusible ink layer sequentially provided next to the ink separation layer.

2. An ink transfer medium according to claim 1, characterized in that the cylindrical alumina base is manufactured by an anodic oxidation step in which an electrolytic solution is put in a hollow aluminum cylinder of small thickness, an electrode is disposed as a cathode at the center of said cylinder and said cylinder is used as an anode.

3. An ink transfer medium according to claim 1, characterized in that the heating resistor layer is $10^{-2}$ Ω·cm to $10^{2}$ Ω·cm in volume resistivity and 500 Å to 10μ thickness.

4. An ink transfer medium according to claim 1, 2, or 3 characterized in that the ink separation layer has a critical surface tension of 39 dyne/cm or less and a thickness of 3μ in thickness.

5. An ink transfer medium according to claim 4, characterized in that the second electrically conductive layer is $10^{-2}$ Ω·cm or less in volume resistivity and 500 Å to 3μ in thickness.

6. An ink transfer medium according to claim 1, 2, or 3 characterized in that the second electrically conductive layer is $10^{-2}$ Ω·cm or less in volume resistivity and 500 Å to 3μ in thickness.

* * * * *

UNITED STATES PATENT AND TRADEMARK OFFICE

CERTIFICATE OF CORRECTION

PATENT NO. : 5,122,409

DATED : June 16, 1992

INVENTOR(S) : Eiichi Akutsu et al.

It is certified that error appears in the above-identified patent and that said Letters Patent is hereby corrected as shown below:

On the title page:

Item (75): Inventors, change "Ebina" ; "Minamiashigara" and "Ebina"to --Kanagawa--.

Item (73): Assignee, change "Fuji-Xerox Co., Ltd., Ebina, Japan to --Fuji Xerox Co., Ltd. Tokyo, Japan--.

Claim 3, column 10, line 11, before "thickness" insert --in--.

Signed and Sealed this

Twenty-eighth Day of June, 1994

Bruce Lehman

*Attest:*

BRUCE LEHMAN

*Attesting Officer*

*Commissioner of Patents and Trademarks*